US006459053B1

(12) United States Patent
Roberts

(10) Patent No.: US 6,459,053 B1
(45) Date of Patent: Oct. 1, 2002

(54) OVERTOGGLED INTERRUPTER SWITCH ASSEMBLY

(75) Inventor: Gerald Bernard Roberts, Monroe, MO (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/457,593

(22) Filed: Dec. 9, 1999

(51) Int. Cl.[7] ..... H01H 31/00
(52) U.S. Cl. ..... 200/48 R; 200/48 A
(58) Field of Search ..... 200/28, 48 A, 200/48 R–48 CB, 49, 12, 48 SB, 48 KB, 401, 400; 218/14, 16, 17, 20, 21, 152, 153, 154

(56) References Cited

U.S. PATENT DOCUMENTS 2,737,556 A * 3/1956 MacNeill et al. ..... 200/150
4,027,125 A * 5/1977 Peek et al. ..... 200/148 R
4,049,936 A * 9/1977 Frink et al. ..... 200/146 R
4,090,051 A * 5/1978 Frink et al. ..... 200/144 R
4,110,579 A * 8/1978 Frink et al. ..... 200/146 R
4,622,443 A * 11/1986 Mooz ..... 200/50 R
5,457,292 A 10/1995 Harr
5,483,030 A 1/1996 Bridges

* cited by examiner

*Primary Examiner*—Elvin Enad
*Assistant Examiner*—Lisa N Klaus
(74) *Attorney, Agent, or Firm*—Mark S. Bicks; Marcus R. Mickney

(57) ABSTRACT

A group operated overhead switch for high voltage power lines includes a rotatable overtoggle mechanism linked to a control shaft and a plurality of switch phases secured to a crossarm support. The overtoggle mechanism can be rotated to and from a closed position and an open position, either of which can be overtoggled, that provides the operator with an affirmative snap when the switch is moved into an overtoggled position.

The use of switch assemblies made of rotatable switch phases and a corresponding immobile electrical connector mounted on the same assembly support allows factory manufacture of modular switch assembly components for high quality control, consistent performance, and accurate component alignment. These supported switch assemblies are then mounted under factory controlled conditions on a dimensionally stable support crossarm and linked by group operated linkages with a switch overtoggle mechanism for actuation. This entire switching assembly can be mounted on a utility pole as a pre-manufactured unit.

9 Claims, 3 Drawing Sheets

OVERTOGGLED INTERRUPTER SWITCH ASSEMBLY

FIELD OF THE INVENTION

The invention relates to overtoggled operating mechanism for high voltage interrupting switch used for overhead power distribution systems that provides secure closure forces adjacent the switch to prevent against accidental blade opening. The invention is particularly useful for plural switch systems such as those found in three switch phase systems used on overhead power lines.

BACKGROUND OF THE INVENTION

Overhead electric power distribution lines are supported on utility poles that may be 40–50 feet high. Horizontal supports mounted to the pole often carry various distribution apparatus. Because such distribution lines commonly operate in a three-phase system with three lines mechanically connected to the horizontal support and electrically insulated from each other, there are three associated lines which ordinarily must be switched and reconnected simultaneously for maintenance or rerouting of power in case of fault. This simultaneous switching process requires some form of group operated switch system.

Group operated circuit switching devices have rotatable or sliding parts which are exposed to the weather where they may become corroded, or where they may become immobilized in the winter because of ice formed on the parts. Exposed components of a switching device are not easily operated and, in addition, are often aesthetically undesirable.

Currently, many high voltage switch operating mechanisms for overhead power distribution lines rely on a flowable handle connected to a control shaft that passes up the utility pole to a rotatable bearing on one of the three switch phases near or at the horizontal support beam. See U.S. Pat. No. 5,483,030 the disclosure of which is herein incorporated by reference. A universal control section is securely connected to the rotatable switch phase bearing so that rotation of the bearing is translated into lateral displacement of an interphase shaft along the horizontal support beam. Conductive switch blades on each switch phase connection can be rotated into or out of electrical connection the respective phase line. When the handle on the control shaft is rotated, the interphase shaft rotates the switch phases. Load interrupters of the type described in U.S. Pat. No. 5,457,292 (herein incorporated by reference) suppress the formation of damaging arcs as the switch blades are opened.

High voltage switches are typically mounted well above ground and experience a variety of externally applied forces from weather, utility pole deformation, and vibration that can tend to open the high voltage contacts over time. Thus, the handle on control shaft must maintain the security required to prevent unintended opening of the conductive blades. It would be a desirable advance in the art to provide an improved means independent of the handle and control shaft for securing high voltage overhead power switch blades in a closed position for service yet allow opening for maintenance.

Unfortunately, the use of a control shaft that passes up through the length of the utility pole represents a source of maintenance. It would be desirable to have a switch mechanism for high voltage overhead power systems that did not require the use of a handle and control shaft running the height of the utility pole to hold the switch blades in a closed position. If a handle was used, however, the switch mechanism would provide a means atop the pole for securing the switch components in a closed position and thereby reduce the criticality of a securing system for the ground level handle.

Traditionally, group operated switch assemblies were installed and adjusted in the field to form an overhead switching system. A typical three phase installation would include a pair of parallel horizontal support beams mounted to an upright pole. The two support beams would support the three phases and conductor tension dead ending.

The field installation required installation of three individual phases and one or more interphase shafts with subsequent adjustment control arm linkages between the switch phases for proper blade opening and closing positions. These steps were often performed atop the support pole under circumstances that were less than ideal for consistent alignment. Periodic inspection was required to prevent against premature wear or damage to the switch due to loss of proper adjustment through vibration, weathering of support components, and dimensional changes in the utility pole (e.g., twisting).

It would be desirable to have a group operated switch assembly for high voltage power lines that could be a pre-assembled switch with overtoggled operation. Manufacture under the controlled conditions of a factory could result in a high degree of reliability and operation that would resist fluctuations in component positions over an extended period of exposure to outdoor weather.

SUMMARY OF THE INVENTION

It is an object of the invention to provide a means for securing a switch assembly in a closed and/or open position.

It is also an object of the invention to provide a switch system for high voltage three phase distribution systems that provides forces to maintain the switchblades in a closed and/or open position despite ambient wind, weather, and vibration.

A further object of the invention is a high voltage overhead distribution system switching assembly that can be pre-manufactured under controlled manufacturing conditions. The manufacture would preferably rely on a modular construction of phase switches for all the benefits that normally flow from modular systems, i.e., higher quality, lower cost, enhanced reliability, better engineering design, etc.

In accordance with these and other objects of the invention that will become apparent from the description herein, the high voltage switching assembly of the invention includes: a plurality of switch phases rotated between closed and open positions by pivotable, rigid connection arms operated by a rotatable overtoggle mechanism having an open position and a closed position. Either or both of the open and closed positions can be overtoggled to secure the switch blades in position.

In a particularly preferred embodiment of the invention, a group operated circuit switching apparatus according to the invention comprises:

a. a plurality of said switch phases that rotate about a first axis between a closed position and an open position relative to an unmoving electrical connection on a support member in a second axis, wherein each of said switch phases is secured to a rigid switch arm with a first end and a second end extending therefrom;

b. a rigid interphase shaft connected to each said second end of each switch arm whereby displacement of said interphase shaft rotates each of said switch phases from said open position or said closed position;

c. an overtoggle mechanism that can be mounted on a first support and rotated about a third axis between an open position and a closed that is more than 90° in rotation from said open position, said overtoggle mechanism being pivotally connected to a first end of said switch arm by a reach rod; and d. a handle communicating with said overtoggle mechanism that will rotate said overtoggle mechanism between the closed and open positions.

The switch assembly of the present invention provides a switch that provides positive feedback and maximum force with minimal operating effort for service personnel when the switch is opened or closed. The design lends itself to factory construction for advantageous quality control and optimum performance. With weather resistant structural and component materials, the switching assembly can withstand extended exposure to climatic variations without significant deterioration of switching performance.

DETAILED DESCRIPTION

Figure 1:
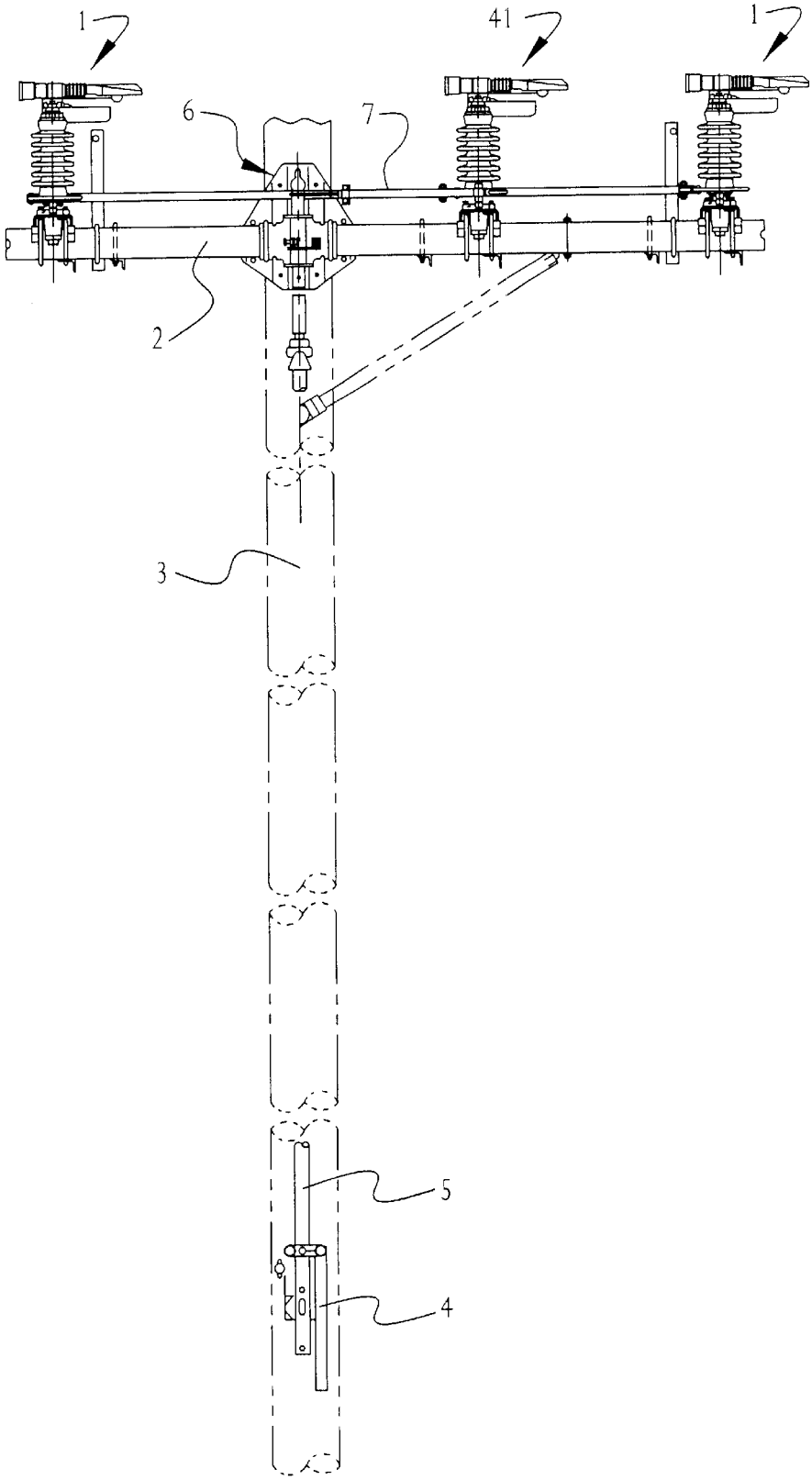
FIG. 1 is an illustration of a switching assembly according to the invention on a utility pole and a ground level handle mechanism.

The group operated switch assembly of the present invention is fully described in a brochure entitled "Hubbell Automation Ready Distribution Systems", Bulletin No. 14-9901 (1999) available from Hubbell Power Systems, Inc., 210 N. Allen Street, Centralia, Mo. 65240. The entire disclosure of this brochure is herein incorporated by reference.

Briefly described in the context of a three phase switch, the present switch assembly is made of three modular switch phases operated simultaneously by displacement of a rigid interphase shaft. The interphase shaft is initially urged to move by pivotal, rigid linkages through at least one of the switch phase levers on a switch phase module which is, in turn, pivotally and rigidly linked to an overtoggle mechanism that rotates between a closed position and an open position. The design and relative angular displacements of the overtoggle mechanism allow for a relatively easy translation with minimal effort from top dead center to a position over dead center and secured in place. Despite the security of the overtoggled position (either open or closed), minimal effort is needed to rotate the mechanism back to dead center and, with advantageous mechanical advantage now restored to the displacement stroke, the switch mechanism can be completed with relative ease. Such mechanical advantage can often be quite necessary to overcome corroded moving parts, ice built up on the mechanism, and/or the significant repulsion forces between the switch blade and stationary contact as the blade approaches the mated electrical connection.

Preferably, the switch assembly has a modular construction based on a plurality of switch phase subassemblies mounted in alignment on the same support arm. A plurality of these subassemblies can be mounted under factory conditions on a dimensionally stable support beam and readily interconnected to an interphase shaft, overtoggle mechanism, and reach rod to form a group operated switch with proper alignment.

The switching switch assembly of the invention is most conveniently described with reference to the three phase horizontal system shown in the figures. Similar structural features will be noted with the same reference number. Although the invention is described in connection with a three phase high voltage distribution system using a horizontal support member and three vertically disposed switches supported thereon (a "horizontal" configuration), the invention is equally applicable to a wide variety of switch assembly orientations including a delta configuration (two switches on a horizontal support with a middle switch on the pole at a higher elevation), a vertical configuration (switches extend horizontally and perpendicular to horizontal support with switches moving in a vertical plane), and phase-overphase configurations (switches extend horizontally and perpendicular to vertical utility pole at different elevations).

The invention is also described in connection with manual operation of the switch. It is to be understood that the overtoggled switching mechanism can also be operated with a motor drive system for remote actuation of the switch linkages.

As shown in the figures, drive switch phase 41 and a plurality of switch phases 1 are mounted to and supported on support crossarm 2 secured at an upper end of utility pole 3. Preferably, support crossarm 2 is made of a weather resistant, dimensionally stable, structural material. Handle 4 acts on control shaft 5 to turn rotatable overtoggle mechanism 6 thereby displacing control shaft interphase shaft 7 and simultaneously turning switch phases 1, 41 between open and closed positions.

Figure 2:
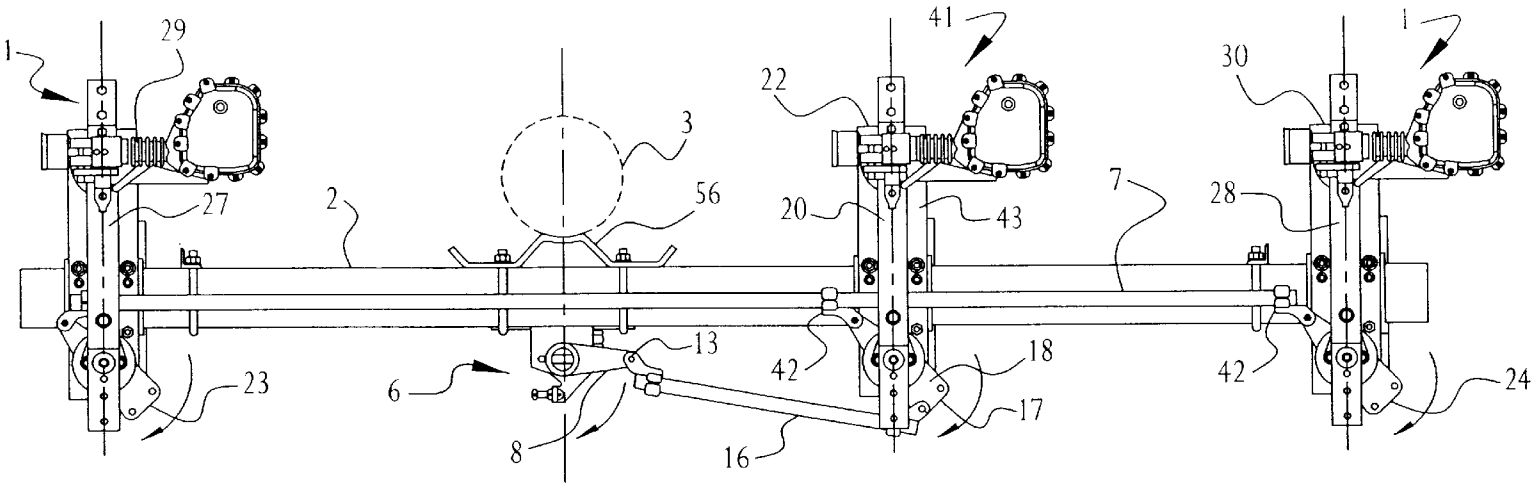
FIGS. 2 and 3 are top and side views, respectively, of a three phase switch assembly with an overtoggled switch mechanism.
Figure 3:
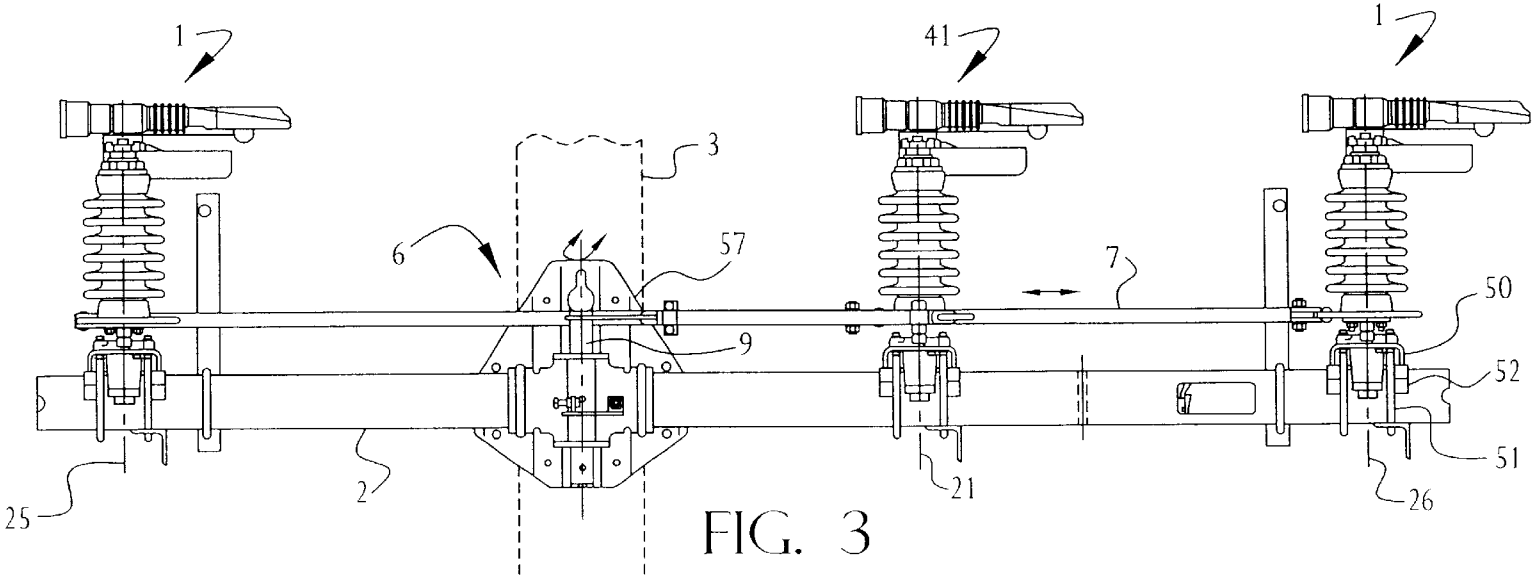
Figure 4:
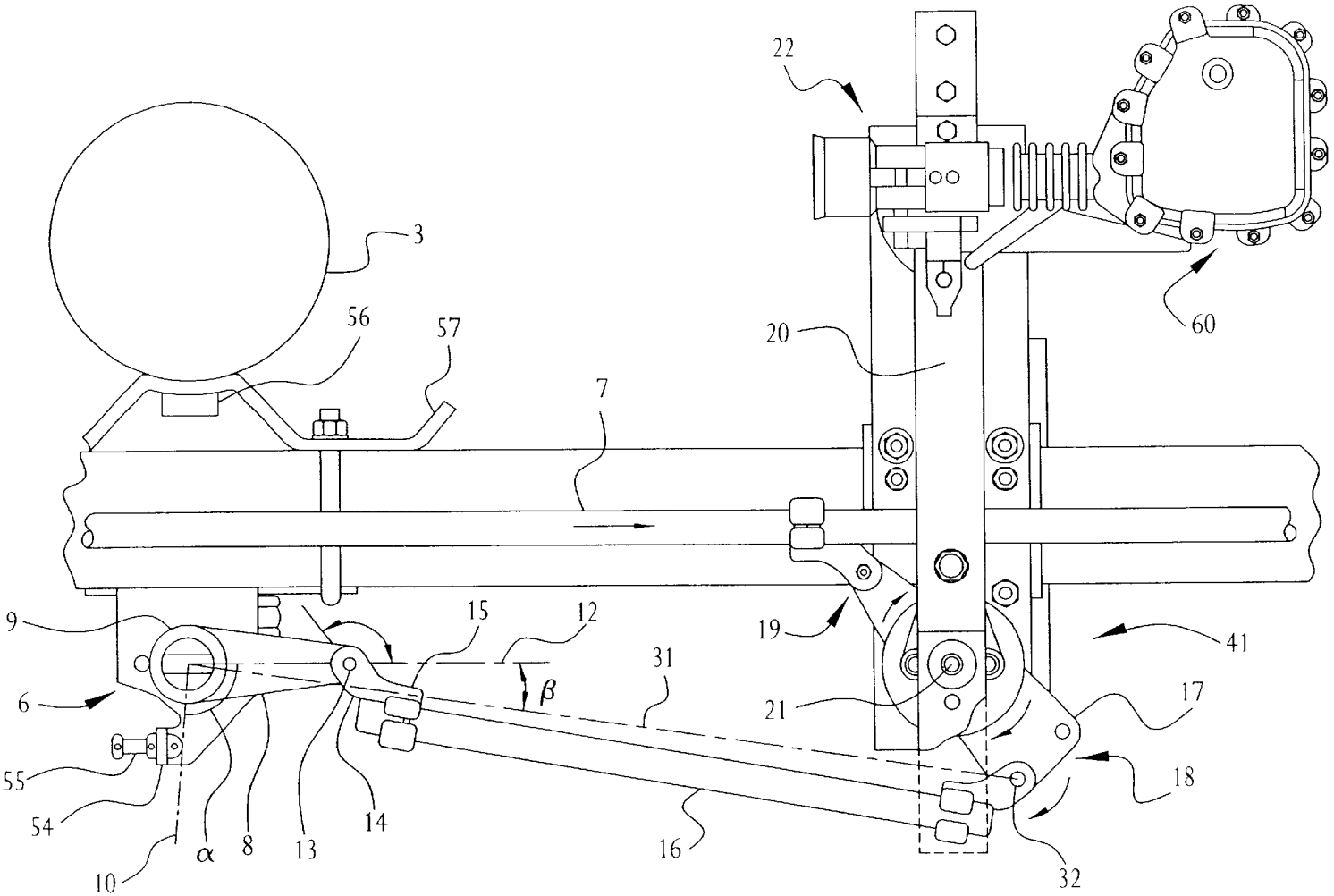
FIG. 4 is a detailed depiction of the switching switch assembly of FIGS. 2 and 3.

As shown in more detail in FIGS. 2–4, rotatable overtoggle mechanism 6 includes overtoggle lever 8 secured to and rotating with overtoggle pipe 9. Pipe 9 is able to rotate from a closed position at axis 12 to an open position 10 over angle a. Angle a should be more than 90° to provide an overtoggled connection. Second end 15 of overtoggle clamp 14 is secured to reach rod 16 which is, in turn, pivotally connected at switch phase lever 17 of drive switch phase 41 at first end 18. The second end 19 of switch phase lever 17 is pivotally connected to interphase shaft 7. Drive switch phase 41 with insulator between lever 17 and switch blade 20 is secured to switch phase lever 17 between ends 18, 19 on axis 21 so that rotation of switch phase lever 17 also rotates switch blade 20 either into or out of engagement with a corresponding stationary contact 22.

Preferably, stationary contact 22 includes interrupter 60 that reduces or eliminates arcing as blade connector is moved from a mating stationary contact 22.

Switch phases 1 are pivotally connected to interphase shaft 7 with their own switch phase levers 23, 24 so that as interphase shaft 7 is displaced along support crossarm 2 by force from switch phase lever 17, switch phases 1 are pulled or pushed into rotation about parallel axes 25, 26 so that switch blades 27, 28 are rotated relative to stationary contact 29, 30.

An overtoggled connection is used to prevent unintended disengagement of blades 20, 27, 28 from stationary contacts 22. Overtoggle is formed by the interaction relative to the angle β between centerline 12 and centerline 31. Overtoggle is created by an acute angle relative to axis 12 of overtoggle lever. A pivotal connection 11 allows angular force from reach rod 16 to bear on lever 8 and hold lever 8 in position. Rotation of overtoggle lever 8, however, forces reach rod 16 away from interphase shaft 7 on pivot 32 and allows switch phase lever 17 to rotate around axis 21 in a second plane and urges interphase shaft 7 to rotate all switch phase blades 20, 27 and 28 in unison. The switch phase blades 20, 27 and 28 rotate about axes 21, 25 and 26 in a first plane that is substantially transverse to the second plane in which the switch phase levers (rigid connection arms) 17, 23 and 24 rotate. Operation in reverse will close all switch phases.

The overtoggled switch system of the present invention is preferably assembled under factory controlled conditions as an accurately aligned switch subassembly comprising a plurality of rotatable switch phases and a corresponding number of immobile electrical connectors with mating stationary contacts on a single support member made of a dimensionally stable material that could be mounted as an integral assembly to a vertical utility pole. Such a subassembly would allow the manufacture of component switch and connector mating units that could be quickly mounted to the support beam and pivotally connected to a central control arm for group operation.

The component nature of the present assembly is best shown in FIGS. 2–4 wherein following switch phases 1 are essentially identical in construction to drive switch phase 41 except for the additional linkage of reach rod 16 to overtoggle lever 8 for operation. By using an open ended clamp 42 for securing switch phase lever 17, 23, and 24 to interphase shaft 7, switch phases 1, 41 need to be secured to only a single crossarm support 2. Rotatable overtoggle mechanism 6 is similarly secured to support crossarm 2 under the controlled conditions of a manufacturing line or factory so that overtoggle mechanism 6 is properly positioned relative to drive switch phase 41 and the corresponding linkages.

Prior assembly of stationary contact 22 and drive switch phase 41 on the same transverse switch phase base 43 assures proper positioning of these components for proper mating of blade 20 in a mating slot of stationary contact 22. In particular, each switch phase 1, 41 is made with "U" shaped switch phase base 50 secured with a pair of U-bolts 51 and base spacer 52 to support crossarm support 2. Base spacer 52 provides tension force against U-bolts 51 to secure the switch assembly to the support crossarm as well as provide a bearing surface to resist torsional forces created by the overtoggled positioning as the switch is opened and closed. Further details of base spacer 52 are set forth in my copending application Ser. No. 09/456,314 filed on Dec. 8, 1999, the disclosure of which is herein incorporated by reference.

Switch phases 1, 41 are initially secured to support crossarm 2 at a position that roughly estimates the final position. Drive switch phase 41 is then connected to overtoggle lever 8 of overtoggle mechanism 6 and adjusted in length to provide an overtoggled closed position and/or overtoggled open position for overtoggle lever 8 and an open position that is at least 90° in rotational position from the opposite position. Adjustable overtoggle stop 54 is then adjusted by screw 55 to provide an overtoggle angle so that drive switch phase 41 does not accidentally close or open. Switch phases 1 are subsequently adjusted in position on support crossarm 2 so that displacement of interphase shaft 7 simultaneously opens or closes all switch phase blades. Once adjusted, all connections are tightened and secured to produce a unitary assembly that is directly mounted with bolts 56 through holes in plate 57 to utility pole 3.

Installation of an overhead power distribution switch assembly according to the invention thus consists essentially of securing a support crossarm to a vertical utility pole wherein the support arm carries a plurality of pre-manufactured, pre-aligned, group operated switch phases actuated by a overtoggle mechanism having an open position and an overtoggled closed position.

What is claimed is:

1. A group operated circuit switching apparatus, comprising:

a. a plurality of switch phases that rotate about a first axis between a closed position and an open position relative to a stationary contact on a support member, wherein each of said switch phases is secured to a rigid switch phase lever with a first end and a second end extending therefrom;

b. an interphase shaft connected to each said second end of each switch phase lever whereby displacement of said interphase shaft along said support member rotates each of said switch phase levers from said open position or said closed position;

c. an overtoggle mechanism that is rotatable between an open position and a closed position that is more than 90° from said open position, said overtoggle mechanism being pivotally connected to a first end of said switch phase lever by a reach rod; and d. a handle communicating with said overtoggle mechanism that rotates said overtoggle mechanism between said closed position and said open position.

2. A switching apparatus according to claim 1 wherein said first end and said second end of each of said switch phase levers includes a pivotable connector.

3. A switching apparatus according to claim 1 wherein said overtoggle mechanism includes an overtoggle lever extending from a control shaft in a first direction that is pivotally connected to said reach rod by an overtoggle connector that angularly offsets said overtoggle lever relative to said reach rod.

4. A switching apparatus according to claim 3 wherein said overtoggle connector has a first connection end secured to said overtoggle lever and a second connection end secured to said reach rod, wherein said first connection end is at an obtuse angle relative to said second connection end.

5. An article of manufacture comprising the switching apparatus of claim 4 with a plurality of rotatable switch phases communicating with mated stationary contacts, each rotatable switch and stationary contact secured to a support base that is secured to said crossarm support, and each is linked by a switch phase lever to an interphase shaft whereby movement of said overtoggle mechanism from said open position to said closed position provides a positive snap feedback upon reaching said closed position.

6. A component-based switching assembly for switching high voltage overhead power line circuits, comprising:

a. a support crossarm extending along an axis;

b. a plurality of switch phases supported on said crossarm, each of said switch phases including a stationary contact secured to a support base and a rotatable switch also linked to said support base, said switch including an insulator, a switch blade, and a switch phase lever linked to rotate said switch blade into and out of contact with said stationary contact;

c. an interphase shaft pivotally connected to a first end of said switch phase lever whereby said switch blade rotates between an open position and a closed position when said interphase shaft is displaced; and d. an overtoggle mechanism mounted on said support crossarm and rotatable between an open position and an overtoggled closed position that is more than 90° from said open position, said overtoggle mechanism being pivotally linked to a reach rod pivotally connected to a second end of said switch phase lever.

7. A switching assembly according to claim 6 wherein each of said switches is secured in an open position by an overtoggled connection.

8. A switching assembly according to claim 6 wherein each of said switches is secured in a closed position by an overtoggled connection.

9. A switching assembly according to claim 6 wherein each of said switches is secured in an open position and in a closed position by an overtoggled connection.

* * * * *